US005701726A

United States Patent [19]

Smith

[11] Patent Number: 5,701,726

[45] Date of Patent: Dec. 30, 1997

[54] PACKAGING APPARATUS FOR NON-ROUND CONTAINERS

[75] Inventor: Brenton L. Smith, Alexandria, Minn.

[73] Assignee: Brenton Engineering Co., Alexandria, Minn.

[21] Appl. No.: 787,315

[22] Filed: Jan. 24, 1997

[51] Int. Cl.[6] ..... B65B 35/56

[52] U.S. Cl. ..... 53/544; 53/252; 53/531; 53/534; 53/543; 198/415; 198/419.3

[58] Field of Search ..... 53/48.7, 251, 252, 53/446, 531, 534, 542, 543, 544; 198/419.2, 419.3, 429, 430, 373, 410, 411, 412, 413, 414, 415, 416

[56] References Cited

U.S. PATENT DOCUMENTS

| | | | |
|---|---|---|---|
| 2,642,212 | 6/1953 | Currivan | 53/252 |
| 2,667,959 | 2/1954 | Rogers | 198/416 |
| 3,331,184 | 7/1967 | Krans | 53/544 X |
| 3,427,779 | 2/1969 | Goldman | 53/531 X |
| 3,827,211 | 8/1974 | Zavatone et al. | 53/48.7 |
| 3,930,574 | 1/1976 | Iwata et al. | 198/373 |
| 4,720,006 | 1/1988 | Lenherr | 198/415 |
| 4,807,739 | 2/1989 | Wolf et al. | 198/415 |
| 5,074,400 | 12/1991 | Focke et al. | 198/415 |
| 5,291,720 | 3/1994 | Lashyro et al. | 53/544 X |

*Primary Examiner*—Daniel Moon
*Attorney, Agent, or Firm*—Herman H. Bains

[57] ABSTRACT

A continuous, multiline packaging apparatus for continuously conveying, turning, and loading non-round bottles includes infeed conveyors which convey non-round bottles to timing screw conveyors. The timing conveyors are operable to space the bottles a predetermined distance apart and to feed the lines of spaced bottles to turning conveyors. The turning conveyors are each comprised of high and low speed conveyor chains, and guide rails. The turning conveyors first turn the bottles to an intermediate angled position and thereafter further turn the bottles to a loading position. A grouping conveyor comprising a plurality of fights cooperates with the turning conveyors to cause the bottles to form groups which are transferred to a loading device. The loading device continuously shifts the grouped bottles laterally into cartons as the bottles are continuously moved in a downstream direction.

7 Claims, 3 Drawing Sheets

PACKAGING APPARATUS FOR NON-ROUND CONTAINERS

FIELD OF THE INVENTION

This invention relates to a continuous packaging machine for conveying, turning and symmetrical packaging of non-round containers.

BACKGROUND OF THE INVENTION

One of the problems involved with packaging apparatus is how to handle and load non-round containers in a continuous packaging system. In such a continuous packaging operation, a group of the items to be packaged, are usually simultaneously loaded mechanically into a crate or a carton to fill the carton. If the items to be packaged are non-round bottles, then these bottles must be correctly oriented or turned before the bottles are grouped for packaging. In prior art systems, non-round bottles are turned (oriented) with specially designed screws and are thereafter grouped before the groups of bottles are loaded into a carton.

SUMMARY OF THE INVENTION

It is an object of this invention to provide novel packaging apparatus for conveying, turning, grouping and loading non-round bottles into cartons in a continuous operation.

The packaging apparatus is preferably a multiline system and includes spacing or timing screw conveyors which are operable to provide spacing between adjacent bottles. The spaced bottles are received by turning conveyors comprised of high speed and low speed conveying chains. The bottles are positioned upon and turned by the differentially driven conveying chains. Guide rails restrain the bottles to an intermediate turned position. A grouping device comprised of a plurality of flights cooperate with the turning conveyors to group a predetermined number of bottles in shingled relation. The bottles are further turned by the grouping device to a loading position. The grouped and turned bottles are then continuously loaded into cartons.

DESCRIPTION OF THE PREFERRED EMBODIMENT

Figure 1:
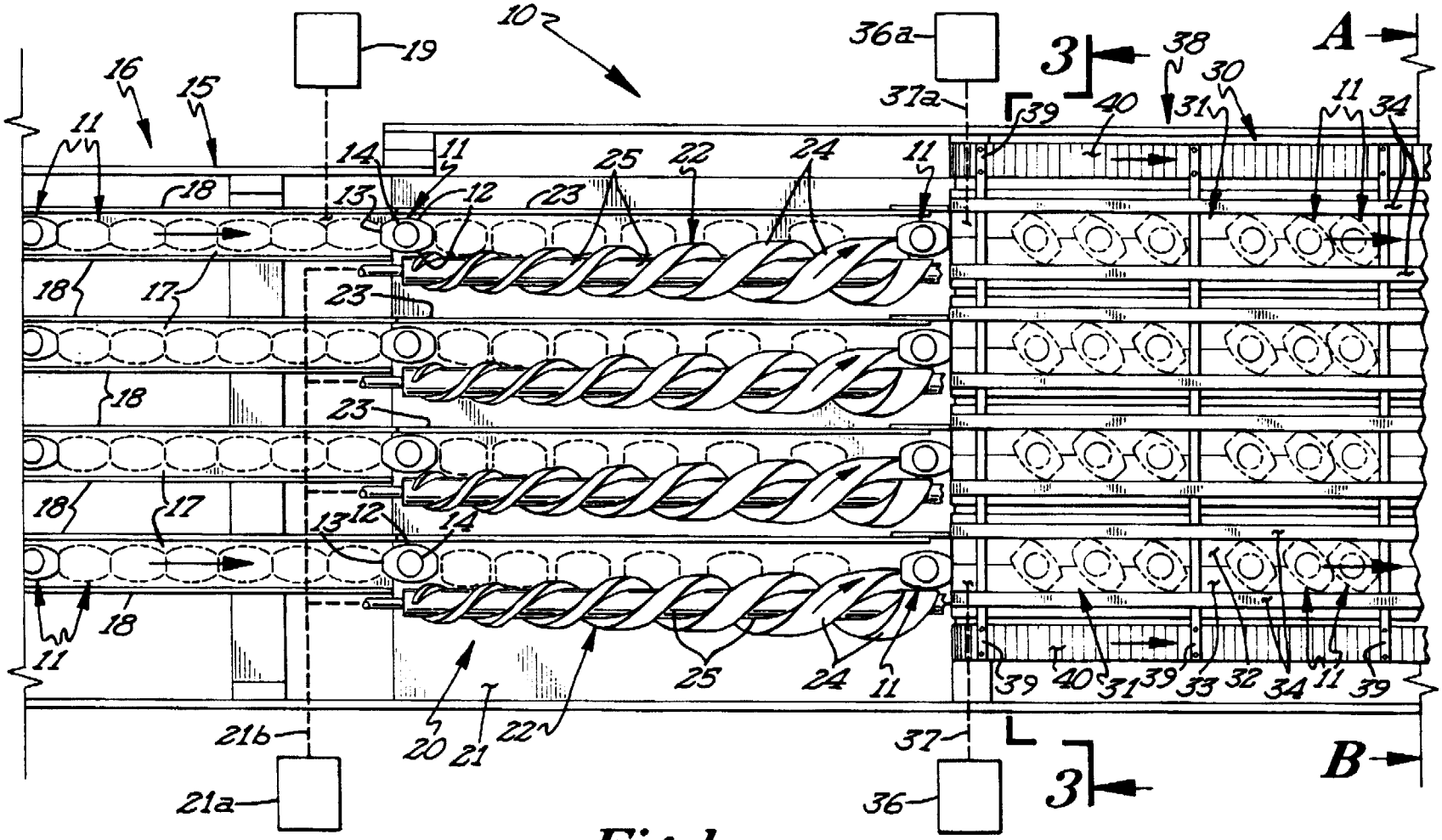
FIG. 1 is a top plan view of one portion of the novel packaging apparatus.
Figure 2:
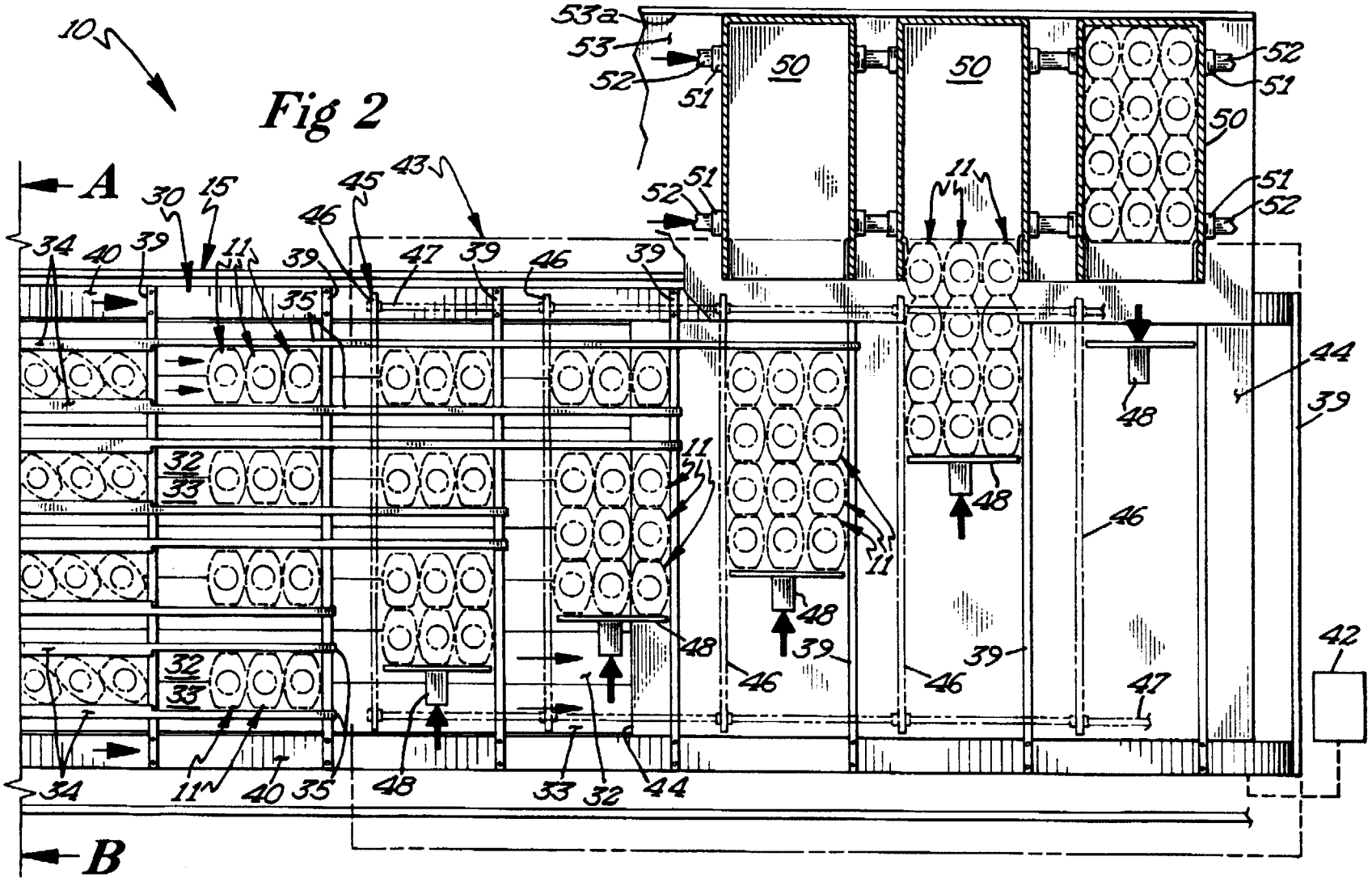
FIG. 2 is a top plan view of the remaining portion of the apparatus.
Figure 3:
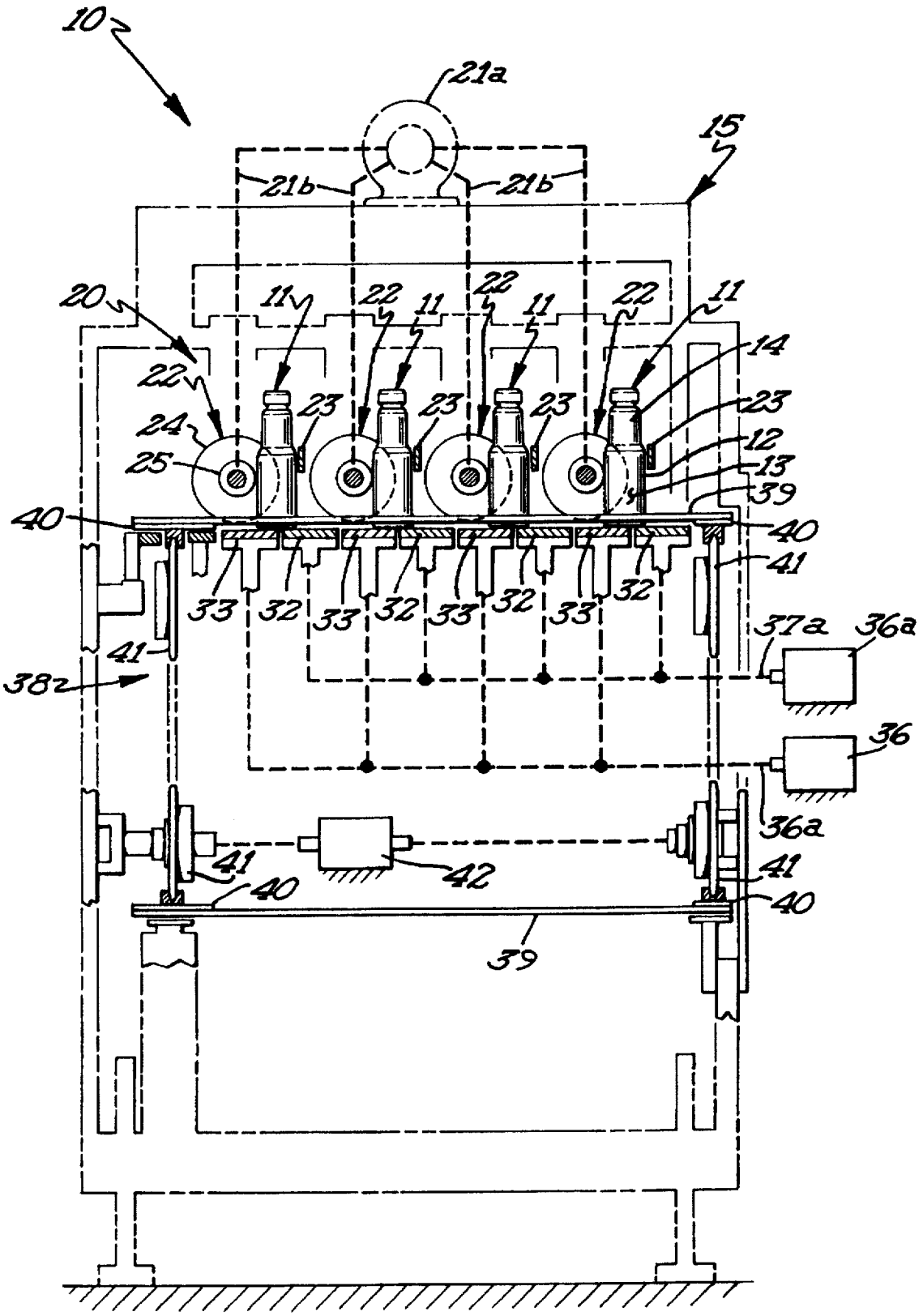
FIG. 3 is a cross sectional view taken approximately along line 3—3 of FIG. 2 and looking in the direction of the arrows.

Referring now to the drawings, it will be seen that one embodiment of the novel packaging apparatus, designated generally by the reference numeral 10, is thereshown. The packaging apparatus is operable to convey, turn, group and load non-round bottles into carton in a continuous operation. The non-round bottles 11 as shown in the drawings have slightly curved sides 12 integral with flat ends 13, a neck 14 and a bottom (not shown). It will be noted that the transverse dimension of the sides 12 is substantially larger than the transverse dimension of the flat ends. These bottles are merely representative of non-round containers and are typically used to contain salad dressings.

The packaging apparatus is diagrammatically illustrated and includes a support frame 15 for supporting the various components thereon. The packaging apparatus includes infeed conveyor means for conveying the non-round bottles 11 in a downstream direction. In the embodiment shown, the infeed conveyor means is comprised of four conveyor belts 17 which are disposed in side-by-side relation so that four separate rows or lines of non-round bottles are conveyed. While the present embodiment of the packaging apparatus includes four lines, it will be appreciated that the number of lines may be varied at will. Each conveyor belt 17 include an upper horizontal run which is located between a pair of laterally spaced apart substantially parallel guide rails 18. Suitable drive pulleys (not shown) drive the upper run of the conveyor belt 17 in a downstream direction. The drive pulleys are driven by a conventional electric motor 19.

It will be seen that the non-round bottles 11 are disposed in an original conveying position whereby the slightly curved sides are disposed adjacent the guide rails 18. Flat ends 13 of adjacent bottles engage each other as the bottles are moved linearly downstream by the infeed conveyor means.

The non-round bottles 11 are continuously discharged from the infeed conveyor means 16 to a timing or spacing conveyor means 20. It will be noted that the spacing conveyor means 20 is located immediately downstream of the infeed conveyor means and is comprised a plurality of timing or spacing screw conveyors 22 which are horizontally disposed in side-by-side parallel relation with respect to each other. The non-round bottles are moved by the screw conveyors on a flat support surface or plate 21 and are continued in a downstream direction as the screw conveyors separate each adjacent non-round bottle in spaced relation with respect to the adjacent bottles. In the embodiment shown, there are four screw conveyors each receiving bottles from one of the four conveyor belts 17 of the infeed conveyor means.

Each screw conveyor 22 is positioned adjacent a guide rail 23 which is disposed in substantially parallel relation to the longitudinal axis of the screw conveyor 22. Each screw conveyor includes spiral threads 24 extending radially outwardly and helically along the central shaft 25 (minor axis). It will be noted that the radial dimension (major axis) of the spiral thread 24 increases progressively in a downstream direction. It will also be noted that the thickness dimension of the thread, i.e. the distance between the leading edge 26 and the trailing edge 27 of the thread also increases progressively in the downstream direction. Finally, it will be noted that the distance from the surface of the central shaft 25 and the guide rail 23 remains constant throughout the length of each screw conveyor 22.

The screw conveyor 22 are driven by an electric motor 21*a* whose output shaft is connected to screw conveyors by drive connections 21*b*. The interaction of the bottles with the spacing or timing screws 22 and with the guide rails cause the bottles to become spaced apart. Specifically, the increase in thickness dimension of the thread of each screw 22 is an efficient cause of this spacing. The spacing of the bottles is optimum with respect to the subsequent turning and grouping operation.

The spaced apart lines of bottles are discharged from the spacing conveyor means 20 to turning conveyor means. The turning conveyor means 30 is located immediately downstream of the spacing conveyor means. The turning conveyor means includes four turning conveyors 31 each positioned to receive bottles successively discharged from one of the screw conveyors 22. Each turning conveyor 31 is comprised of a high speed endless chain or belt conveyor 32 and a low speed endless chain or belt conveyor 33. The respective upper runs of the high speed endless chains 32 and the low speed chains 33 are disposed horizontally and are arranged in side-by-side relation. Each turning conveyor also includes a first pair of elongate guide rails 34 which are disposed in spaced apart parallel relation with respect to each other and each pair is disposed along the outer edges of the high speed chain and low speed chain.

Because of the differential speed of the chains (high and low speed chains) comprising each turning conveyor, the bottles passing from the spacing conveyor screws will be moved from the original conveying position to the position illustrated in the drawings. In this regard, it will be noted that the bottles are turned approximately 45° from their original end first conveying position. The first guide rails 34 for each turning conveyor 31 constrain movement beyond this position.

It will also be noted that each turning conveyor 31 also includes a second pair of parallel guide rails 35 which extend from the downstream end of the guide rails 34. The spacing between the guide rails 35 is greater than the spacing between adjacent guide rails 34 and is of a magnitude to allow the bottles 11 to be turned another 45° as shown in the drawings. In this regard, the bottles will be arranged so that the ends of the bottles are adjacent the guide rails and a side of each bottle is facing downstream.

An electric motor 36 provided for driving the high speed chains 32, and another electric motor **36*a* is provided for driving the low speed chains 33. Although not shown in the drawings, the output shafts of the motors 36 and 36*a***, respectively, are connected to suitable drive pulleys that drive the low and high speed chains.

A bottle grouping device is 38 is also provided and cooperates with the turning conveyors to cause a predetermined number of bottles to engage each other to form a group. The bottle grouping device includes a plurality spaced apart flights or abutment members 39 which extend transversely of the turning conveyors 31. Flights 39 are disposed in parallel relation with respect to each other and are interconnected adjacent their ends to suitable chains 40. The chains 40 are located exteriorly of the outermost turning conveyors and the lower run of chains and flights is located below the turning conveyors. The chains 40 are trained about pulleys 41 and power is supplied to the pulleys 41 by suitable electric motor 42.

The chains and flights 39 constitute a conveyor and the flights are moved in downstream direction at a velocity slower than the low speed chains 33 of the turning conveyors 31. The speed of the flights is also timed so that three bottles in a conveying line are located between adjacent flights 39. As each turning conveyor 31 moves the bottles to the intermediate angulated position, the lead bottle of each group of three will engage the trailing edge of a flight 39. Since the lead bottle of a group is slowed by a flight, the other two bottles of this group will catch up with the lead bottle and engage each other in shingled relation as illustrated in the drawing. The bottles will continue their movement in this shingled relation in a downstream direction until each group of bottles passes between the second pair of guide rails 35. The bottles are not constrained by guide rails 34 and are free to turn another 45° to the final loading position. This turning is caused by the high and low speed conveyors of each turning conveyor in cooperation with a flight 39.

After the bottles are grouped and turned to the loading position, the bottles are moved in a downstream direction to a loading device 43.

The loading device includes a horizontal plate 44 which supports the bottles are they are moved along this surface. The plate 44 is located immediately downstream of the turning conveyors and receives bottles therefrom. Means are provided for continuing movement of the grouped bottles in a downstream direction along the plate 44 and includes a bar conveyor 45 comprised of a plurality of transverse spaced apart, parallel bars 46 extending transversely of the plate 44 and engaging the rearmost bottle of a group. The ends of the bars 46 are connected to drive chains 47 which are trained over sprockets (not shown) driven by a suitable electric motor (not shown). It will be noted that each group of bottles are engaged by a bar 46 of the bar conveyor and a flight 39 of the grouping device conveyor.

The loading device 43 also includes a plurality of pushers 48 which are revolvable in an elliptical pathway by the drive chains 47, and during their movement, each pusher is first positioned adjacent the downstream end of the turning conveyor. The pushers will engage the grouped bottles on the turning conveyors during the terminal portion of their movement downstream on the turning conveyor.

Each pusher is also moveable transversely of the plate 44 as illustrated in the drawings. The pushers will continue moving the grouped bottles received from the turning conveyors as the bottles are being moved by the bar conveyor 45.

The pushers will move transversely of the plate and progressively move the bottles into an open carton 50. In this regard, it will be noted that the guide rails 35 are staggered in a downstream and transverse direction to allow the pusher to push each group of bottles towards the cartons. The cartons 57 have an open end and are engaged by retaining elements 51 secured to conveyor chains 52 which move the cartons at the speed of the bar conveyor 46. The cartons are positioned upon and moved along a horizontal plate 53 which projects laterally from the plate 44. The plate 53 has an outer upturned lip **53*a* for restraining cartons 50** from outward movement from the plate. With this arrangement, the pushers will push the plurality of bottles into each carton. In the embodiment shown, each pusher will push twelve bottles into each carton.

Thus it will be seen that I have provided a novel packaging apparatus for continuously conveying, turning and loading non-round bottles in cartons.

What is claimed is:

1. A continuous packaging apparatus for continuously conveying, turning and loading non-round bottles into cartons, comprising, an infeed conveyor for conveying non-round bottles in an original angular upright position, a spacing conveyor positioned immediately downstream of said infeed conveyor for sequentially receiving bottles from the infeed conveyor, and being operable to continue movement of the bottles in the original angular position in a downstream direction while spacing each bottle a predetermined distance from each adjacent bottle, a turning conveyor disposed downstream of the spacing conveyors, for receiving bottles from the spacing conveyor in the spaced original angular position, being operable to turn each bottle from its original angular position to an intermediate angular position while continuing movement of the bottles in a downstream direction, a bottle grouping device including a plurality of spaced abutment members extending transversely of the turning conveyor, means connecting and moving the abutment members in a downstream direction at a velocity less than the velocity of the turning conveyor, said grouping device cooperating with the turning conveyor to first group a predetermined number of bottles in shingled engaging relation while the shingled bottles remain in the intermediate angular position, the turning conveyor then further turning each group of bottles from the shingled intermediate angular position to an angular loading position, and loading means located adjacent the downstream end position of the turning conveyor for successively receiving, engaging and moving each group of bottles laterally into a carton as each group of bottles is moved in a downstream direction.

2. The packaging apparatus as defined in claim 1 wherein said spacing conveyor comprises an elongate screw conveyor having threads increasing in radial and thickness dimensions in a downstream direction.

3. The packaging apparatus as defined in claim 1 wherein said turning conveyor includes a pair of conveyor belts disposed in side-by-side relation and supporting the bottles in upright relation thereon, one of said turning conveyor belts being operated at a different speed than the other belt, substantially parallel elongate guide rail means positioned above the turning conveyor belts and cooperating therewith to turn the bottles from the original position to a loading position.

4. The packaging apparatus as defined in claim 3 wherein said guide rail means includes a first pair of spaced apart first guide rails and a second pair of guide rails, the spacing between said first guide rails; the spacing between said first guide rails restraining movement of the bottles to the intermediate angular position, and the spacing between said second pair of guides permitting further angular movement of the bottles to the loading position.

5. A continuous multiline packaging apparatus for continuously conveying, turning and loading non-round bottles into cartons, comprising, a plurality of infeed conveyors disposed in side-by-side relations for conveying non-round bottles in an original angular upright position, a plurality of spacing conveyors disposed in side-by-side relation and each spacing conveyor being positioned immediately downstream of an infeed conveyor for sequentially receiving bottles from the infeed conveyor and being operable to continue movement of the bottles in the original angular position in a downstream direction while spacing each bottle a predetermined distance from each adjacent bottle, a plurality of turning conveyors arranged in side-by-side relation and disposed downstream of the spacing conveyors, each turning conveyor receiving bottles from a spacing conveyor in the spaced original angular position, each turning conveyor being operable to turn each bottle from its original angular position to an intermediate angular position while continuing movement of the bottles in a downstream direction, a bottle grouping device including a plurality of spaced abutment members extending transversely of the turning conveyors, means connecting and moving the abutment members in a downstream direction at a velocity less than the velocity of the turning conveyor, said grouping device cooperating with the turning conveyor to first group a predetermined number of bottles in shingled engaging relation while the shingled bottles remain in the intermediate angular position, each turning conveyor then turning each group of bottles from the shingled intermediate angular position to an angular loading position, and loading means located adjacent the downstream end position of the turning conveyors for successively receiving, engaging and moving each group of bottles laterally into a carton as each group of bottles is moved in a downstream direction.

6. The packaging apparatus as defined in claim 5 wherein each of said turning conveyors includes a pair of conveyor belts disposed in side-by-side relation and supporting the bottles in upright relation thereon, one belt of each pair operating a different velocity than the other belt of each pair, substantially parallel, spaced apart guide rail means positioned above the turning conveyor belts and cooperating with the conveyor belts for turning the bottles from the intermediate angular position and then to the loading position.

7. The packaging apparatus as defined in claim 5 wherein said spacing conveyors each comprises an elongate screw conveyor having threads increasing in radial and thickness dimensions in a downstream direction.

* * * * *